US005775154A

United States Patent [19]

Haberkamm

[11] Patent Number: 5,775,154

[45] Date of Patent: Jul. 7, 1998

[54] METHOD FOR ADJUSTING A ROLL GAP

[75] Inventor: Klaus-Dieter Haberkamm, Siegen, Germany

[73] Assignee: SMS Schloemann-Siemag Aktiengesellschaft, Düsseldorf, Germany

[21] Appl. No.: 584,968

[22] Filed: Jan. 11, 1996

[30] Foreign Application Priority Data

Jan. 7, 1995 [DE] Germany ..... 195 00 336.5

[51] Int. Cl.[6] ..... B21B 31/07

[52] U.S. Cl. ..... 72/248; 72/247; 72/13.4; 72/14.4; 72/7.1

[58] Field of Search ..... 72/10.7, 12.1, 72/13.4, 14.1, 14.4, 245, 248, 10.1, 13.6, 240, 247, 7.1

[56] References Cited

U.S. PATENT DOCUMENTS

| | | | |
|---|---|---|---|
| 3,389,588 | 6/1968 | Reinhardt et al. | 72/10.7 |
| 3,961,509 | 6/1976 | Dohrmann | 72/10.7 |
| 4,054,043 | 10/1977 | Eibe | 72/10.7 |
| 4,773,246 | 9/1988 | Perret | 72/10.1 |
| 5,540,072 | 7/1996 | Nishimura | 72/10.1 |
| 5,560,237 | 10/1996 | Yasuda et al. | 72/13.4 |

FOREIGN PATENT DOCUMENTS

| | | | |
|---|---|---|---|
| 619915 | 1/1986 | Japan | 72/10.7 |
| 2303616 | 12/1990 | Japan | 72/10.1 |
| 5169120 | 7/1993 | Japan | 72/10.1 |
| 6297013 | 10/1994 | Japan | 72/10.7 |

*Primary Examiner*—Lowell A. Larson
*Assistant Examiner*—Ed Tolan
*Attorney, Agent, or Firm*—Friedrich Kueffner

[57] ABSTRACT

A method for adjusting the roll gap in strip rolling mills including a roll stand equipped with hydraulic adjusting devices on the drive side as well as on the operator side, wherein the positions of the rolls in a roll stand are adjustable by means of the hydraulic adjusting devices. Prior to the beginning of rolling, the stand is calibrated in a reproducible state. For any changes of the stand geometry and/or the force proportions in the stand, position changes of the adjusting devices corresponding to and resulting from these changes are determined. Changes in the stand geometry and/or the force proportions adjusted or occurring during the rolling operation are regulated by utilizing the difference between the determined corresponding adjusting positions on the drive side and the operator side and by controlling the adjustment toward zero.

4 Claims, No Drawings

METHOD FOR ADJUSTING A ROLL GAP

BACKGROUND OF THE INVENTION

1. Field of the Invention

The present invention relates to a method for adjusting the roll gap in strip rolling mills including a roll stand equipped with hydraulic adjusting devices on the drive side as well as on the operator side, wherein the positions of the rolls in a roll stand are adjustable by means of the hydraulic adjusting devices.

2. Description of the Related Art

It is known in the art to influence the roll gap of the rolls in a roll stand by displacing the rolls and/or by changing the angle between the rolls and/or by bending the rolls. These influences, as well as influences due to changes in the forces applied to the roll stand, also result in changes in the adjustment of the rolls. The stand is usually calibrated in a reproducible state, for example, after a roll change. In that situation, the components used for the adjustment are in a neutral position or initial position.

Since the lower rolls of a roll stand are supported on the foundations in a relatively rigid manner, while the upper rolls of a roll stand are supported less rigidly on the housing, the above-described influences with respect to the stand geometry or the force proportions result in a departure from the initial position which, in turn, produces the result that the upper rolls are adjusted to a greater extent than the lower rolls. This leads to undesired changes of the roll gap and the consequence that the inclination of the rolls relative to each other changes.

In the simplest case, for example, the axial displacement of one or more rolls leads to a change in the center of gravity. This changes the moment in relation to the center of the stand determined and compensated during the calibration. The operator must manually change this resulting inclined position in such a way that a suitable roll gap is once again achieved.

SUMMARY OF THE INVENTION

Therefore, it is the primary object of the present invention to provide a method of the above-described type which makes it possible to carry out such roll gap changes very quickly without requiring an experienced operator.

In accordance with the present invention, prior to the beginning of rolling, the stand is calibrated in a reproducible state. For any changes of the stand geometry and/or the force proportions in the stand, position changes of the adjusting devices corresponding to and resulting from these changes are determined. Changes in the stand geometry and/or the force proportions adjusted or occurring during the rolling operation are regulated by utilizing the difference between the determined corresponding adjusting positions on the drive side and the operator side and by controlling the adjustment toward zero.

For any conceivable change of the initial position or of the initial force proportions in which the stand has been calibrated, the corresponding position changes in the adjustment or the changes resulting from the position changes are determined while the stand is otherwise not under load. During the rolling operation, the determined position changes of the adjustment occurring with changing conditions in the stand geometry or changes in the force proportions in the stand are utilized for counteracting the adjustment position changes which inevitably occur during rolling.

DETAILED DESCRIPTION OF THE INVENTION

The method according to the present invention makes it possible to counteract any conceivable change in the stand geometry or the force proportions occurring during rolling without resulting in incorrect adjustments of the roll gap, as they would result, for example, from simple adjustment controls, and to be able subsequently to regulate an optimum desired value.

It is advantageous to place the changes of the stand geometry and/or the force proportions in the stand as well as the position changes of the adjusting devices on the drive side as well as on the operator side into controller memories, so that they are always available during the rolling operation and can be read from the memories to be used for controlling the adjustment positions.

The corresponding adjustment positions resulting from changes in the stand geometry and/or from changes of the force proportions in the stand can be determined prior to the rolling operation by experiments, for example, by plotting curves for the adjustment changes on the drive side and on the operator side in relation to the stand geometry as well as by plotting curves for the adjustment changes on the drive side and on the operator side in dependence on the force proportions. The individual values of these curves are placed in the controller memory.

However, it is also possible to calculate the curves. If computers are available which are sufficiently fast and have an appropriate large capacity, it is not absolutely necessary to place the curves in controller memories. In that the case, the curves can always be recomputed online and the determined values can be utilized at the correct time for the appropriate regulation of the adjustments.

In accordance with a useful feature, an additional control circuit is subordinated to the conventional control circuit for the adjustment of the rolls, wherein the difference between the adjustment positions on the drive side and on the operator side are regulated toward zero in this subordinated control circuit. Correction values which exclude a roll gap change can be switched onto the actual control circuit through this subordinated control circuit.

While specific embodiments of the invention have been shown and described in detail to illustrate the inventive principles, it will be understood that the invention may be embodied otherwise without departing from such principles.

I claim:

1. A method for controlling a roll gap in strip rolling mills equipped with hydraulic adjusting devices on a drive side and on an operator side of a roll stand having rolls, wherein axial positions of the rolls are adjustable by the hydraulic adjusting devices, the method comprising calibrating the stand in a reproducible state prior to rolling, determining for changes of at least one of a stand geometry and force proportions in the stand position changes of the adjusting devices corresponding to and resulting from the changes of the at least one of the stand geometry and the force proportion, and regulating toward zero any changes of at least one of the stand geometry and the force proportions in the stand occurring during rolling by utilizing a difference between the determined adjustment positions on the drive side and on the operator side, further comprising placing values for the determined changes with the determined adjustment positions on the drive side and on the operator side in a controller memory and reading from the controller memory and utilizing for the regulation the adjustment positions corresponding to at least one of the stand geometry and the force proportions in the stand occurring during rolling.

2. The method according to claim 1, comprising determining by experiments the adjustment positions corresponding to each change of at least one of the stand geometry and each change of the force proportions in the stand.

3. The method according to claim 1, comprising computing the adjustment positions corresponding to at least one of each change of the stand geometry and each change of the force proportions of the stand.

4. The method according to claim 1, comprising subordinating the regulation toward zero of the difference of the adjustment positions resulting on the drive side and on the operator side to the adjustment regulation of the stand.

* * * * *